US005369852A

United States Patent [19]

Higashinaka

[11] Patent Number: 5,369,852

[45] Date of Patent: * Dec. 6, 1994

[54] MIXED HOOK/LOOP SEPARABLE FASTENER AND PROCESS FOR ITS PRODUCTION

[75] Inventor: Yukitoshi Higashinaka, Fukui, Japan

[73] Assignee: Kuraray Co., Ltd., Kurashiki, Japan

[ * ] Notice: The portion of the term of this patent subsequent to Aug. 13, 2010 has been disclaimed.

[21] Appl. No.: 64,679

[22] Filed: May 21, 1993

Related U.S. Application Data

[63] Continuation of Ser. No. 805,887, Dec. 12, 1991, Pat. No. 5,231,738.

[51] Int. Cl.[5] ..... A44B 13/00

[52] U.S. Cl. ..... 24/446; 24/448; 24/450

[58] Field of Search ..... 24/446, 448, 450, 452, 24/447, 448, 449, 451, 442, 443, 444, 445, 306; 2/DIG. 6; 248/205.2

[56] References Cited

U.S. PATENT DOCUMENTS

| | | | |
|---|---|---|---|
| 3,009,235 | 11/1961 | Demestral | 24/448 |
| 3,130,111 | 4/1964 | Manjiizumi | 24/446 |
| 3,387,345 | 6/1968 | Savoir | 24/446 |
| 3,405,430 | 10/1968 | Sidelman | 24/450 |
| 3,408,705 | 11/1968 | Kayser et al. | 24/452 |
| 4,216,257 | 8/1980 | Schams et al. | 24/448 |
| 4,541,154 | 9/1985 | Ito et al. | 24/446 |
| 4,672,722 | 6/1987 | Malamed | 24/446 |
| 4,707,893 | 11/1987 | Hashizume et al. | 24/446 |
| 4,920,617 | 5/1990 | Higashinaka | 24/446 |

*Primary Examiner*—Victor N. Sakran

*Attorney, Agent, or Firm*—Oblon, Spivak, McClelland, Maier & Neustadt

[57] ABSTRACT

Mixed hook/loop separable fasteners comprise a base fabric provided on one surface thereof intermixedly with a multiplicity of hook-like fastening elements and a multiplicity of loop-like fastening elements. The hook-like fastening elements having a height of 1.3 to 3.8 mm and the loop-like fastening elements have a height of 1.5 to 4 mm and larger by 0.2 to 2.0 mm than the height of the hook-like fastening elements. The hook-like fastening elements and loop-like fastening elements being provided in a density of 40 to 120 pieces/cm$^2$. Also provided is a process for producing the above separable fasteners, as well as their use.

10 Claims, 9 Drawing Sheets

MIXED HOOK/LOOP SEPARABLE FASTENER AND PROCESS FOR ITS PRODUCTION

This is a continuation, of application Ser. No. 07/805,887, filed on Dec. 12, 1991 now U.S. Pat. No. 5,231,738.

BACKGROUND OF THE INVENTION

1. Field of the Invention

The present invention relates to mixed hook/loop separable fasteners, and more specifically to mixed hook/loop fasteners comprising hook-like fastening elements and loop-like fastening elements, the height of the latter being larger than that of the former, which are arranged adjacent each other on one surface of a base fabric.

2. Description of the Prior Art

Known two-component separable fasteners consist of a male fastener component comprising a base fabric provided on one surface thereof with a multiplicity of hook-like fastening elements comprising synthetic monofilament or shaped plastic projections having a swollen head and a female fastener component comprising a base fabric provided on one surface thereof with a multiplicity of loop-like fastening elements. The engagement of these two multiplicity of fastening elements can closely and integrally adhere the two fastener components, which are readily separable by hand.

These two-component fasteners however should carefully be distinguished from each other when being attached for example to wears. If a male fastener component has been, by mistake, attached to a position where a female fastener component should have been attached, the male fastener component cannot engage with the counterpart male fastener component and hence either one of these male fastener components should once again be removed and replaced by a female fastener component. If the male fastener component had been attached with a hot-melt adhesive or the like to the wear, the replacement is practically impossible. If it had been sewn with a sewing machine, the replacement, although possible, requires a time-consuming work.

On the other hand, mixed hook/loop separable fasteners comprising a base fabric provided on one surface thereof with both fastening elements have been proposed against the usual two-component separable fasteners. Thus, for example Japanese Patent Publication No. 12952/1970 and Japanese Patent Application Laid-open No. 2649/1974 disclose a mixed hook/loop separable fastener comprising a base fabric provided on one surface thereof with a multiplicity of hook-like fastening elements and a multiplicity of loop-like fastening elements, both comprising a synthetic monofilament and positioned intermixedly with each other; and Japanese Patent Application Laid-open No. 33745/1974 discloses a similar fastener comprising a base fabric provided on one surface thereof with a mixture of a multiplicity of plastic projections having a swollen head and a multiplicity of loop-like fastening elements. These separable fasteners use 2 sheets of one and the same type or "component", which comprises on its one surface both hook-like fastening elements and loop-like fastening elements intermixedly, the 2 sheets being integrally attachable to and separable from each other.

While these mixed hook/loop separable fasteners have the advantage of using only one type of fastener component, two pieces of which are attachable to and separable from each other, some problems still occur when they are used. That is, since conventional mixed hook/loop separable fasteners comprise hook-like elements the height of which is 25 to 50% larger than that of loop-like elements, such mixed-type fasteners tend, when not engaged with the counterpart, to engage with and damage, because of the hook-like elements present thereon, those textiles that contact them, such as non-wovens, knitted fabrics, napped fabrics or thin woven fabrics. Besides, such fasteners readily pick up broken or waste threads and naps from the textiles with which they contact. Further they had the same drawback as that of the male fastener components, that they deteriorate the hand of wears or the like to which they are attached, because of their course surface feeling.

To make matters worse, the tensile strength and peeling strength (hereinafter inclusively referred to as "engaging strength") when a pair of conventional mixed hook/loop fastener components are attached to each other are significantly lower than those with the combination of the usual male and female fastener components and than a level applicable for practical purposes. This is considered to be due to the fact that, in conventional mixed hook/loop separable fasteners, the density of the hook-like fastening elements and loop-like fastening elements provided on one surface of a base fabric cannot but be very low, and that the ratio of hook-like fastening elements to the total elements is, unavoidably, very small. As a result, no mixed hook/loop separable fasteners have been commercialized on a large scale.

SUMMARY OF THE INVENTION

Accordingly, an object of the present invention is to provide a useful mixed hook/loop separable fastener exhibiting an engaging strength that is similar to the usual male and female separable fasteners or at least causes no trouble when used in practice, and at the same time being free from drawbacks of the usual male fasteners as described above.

Another object of the present invention is to provide a process for producing efficiently the above mixed hook/loop separable fastener.

The present inventors have studied on so-far proposed mixed hook/loop separable fasteners, in particular those using a synthetic monofilament for the hook-like fastening elements, from the standpoint of manufacturing technique. The mixed fasteners have low densities for constituting hook and loop elements, a still lower density for the former against the latter, and the height of the hooks is significantly larger than that of the loops. These facts were considered to be due to the requirement that, when once-formed formed loops are cut to form hooks, the cutting operation should not damage the adjacent loops that are not to be cut. The inventors have then studied how to cut loops without giving damages to the adjacent loops and found quite unexpectedly that: if the hook-like fastening elements are so set as to have smaller height than the loop-like fastening elements, the loops can be cut into hooks without causing damages to the adjacent loops even when their densities are high and the ratio of the density of hooks is set higher. The increase in the densities increases the engaging strength. These facts have been found to be applicable also to mixed hook/loop separable fasteners utilizing as hook-like fastening elements plastic projections having a swollen head. The present inventors have further studied to materialize the above concept into more useful mixed hook/loop separable fasteners and completed the invention.

The present invention provides a mixed hook/loop separable fastener comprising a base fabric provided on one surface thereof intermixedly with a multiplicity of hook-like fastening elements and a multiplicity of loop-like fastening elements;

said hook-like fastening elements having a height of 1.3 to 3.8 mm and said loop-like fastening elements having a height of 1.5 to 4 mm and larger by 0.2 to 2.0 mm than the height of said hook-like fastening elements, and said hook-like fastening elements and loop-like fastening elements being provided in a density of 40 to 120 pieces/cm$^2$ with the ratio of the former to the total being 40 to 60%.

The present invention also provides a process for producing mixed hook/loop separable fastener, comprising the steps of:

a) alternately providing on one surface of a base fabric:
   - a plurality of loop groups comprising at least one line of round loops formed of a synthetic monofilament, and
   - adjacent each of said line groups comprising lines of round monofilament loops, another line group comprising at least one line of round loops formed of a synthetic multifilament yarn and having a height 0.2 to 2.0 mm larger than that of said monofilament loops;
   - to form 2 classes of loop lines alternately arranged and having different heights on said surface of said base fabric;

b) heat treating said base fabric at a temperature of 190° to 240° C. such that said monofilament loops have a height of 1.3 to 3.8 mm and said multifilament yarn loops have a height of 1.5 to 4 mm and larger by 0.2 to 2.0 mm than that of said monofilament loops; and c) cutting the upper part of said monofilament loops to form hook-like fastening elements.

The present invention still further provides a process for producing mixed hook/loop separable fastener, comprising the steps of:

a) alternately providing on one surface of a base fabric:
   - a plurality of line groups comprising at least one line of round loops formed of a synthetic monofilament, and
   - adjacent each of said line groups comprising lines of round monofilament loops, another line group comprising at least one line of round loops having the same height as that of said monofilament loops and formed of a synthetic multifilament yarn having a smaller heat shrinkage than that of said synthetic monofilament;
   - to form on said surface of said base fabric 2 classes of loop lines alternately arranged and comprising synthetic fibers having different heat shrinkage;

b) heat treating said base fabric at a temperature of 190° to 240° C. such that said monofilament loops have a height of 1.3 to 3.8 mm and that said multifilament yarn loops have a height of 1.5 to 4 mm and larger by 0.2 to 2.0 mm than that of said monofilament loops; and c) cutting the upper part of said monofilament loops to form hook-like fastening elements.

The present invention still further provides a process for producing mixed hook/loop separable fastener, comprising the steps of:

a) providing on one surface of a base fabric a plurality of line groups comprising at least one line of hook-like fastening elements comprising shaped projections having a swollen head and having a height of 1.3 to 3.8 mm, and b) providing, adjacent each of said line groups comprising lines of shaped projections, another line group comprising at least one line of round loops formed of a synthetic multifilament yarn and having a height 0.2 to 2.0 mm larger than that of said hook-like fastening elements,
   - to alternately form 2 classes of lines on said surface of said base fabric, one class comprising lines of hook-like fastening elements and the other class comprising lines of loop-like fastening elements.

The present invention still further provides a process for producing mixed hook/loop separable fastener, comprising the steps of:

a) alternately providing on one surface of a base fabric:
   - a plurality of line groups comprising at least one line of round loops formed of a synthetic monofilament, and
   - adjacent each of said line groups comprising lines of round monofilament loops, another line group comprising at least one line of round loops formed of a synthetic multifilament yarn;

b) cutting the tops of said monofilament loops; and c) fusing the cut ends of said monofilament pieces with a heating means to form a swollen head having a height from the base fabric of 1.3 to 3.8 mm and smaller by 0.2 to 2.0 mm than the height of said multifilament yarn loops.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1B:
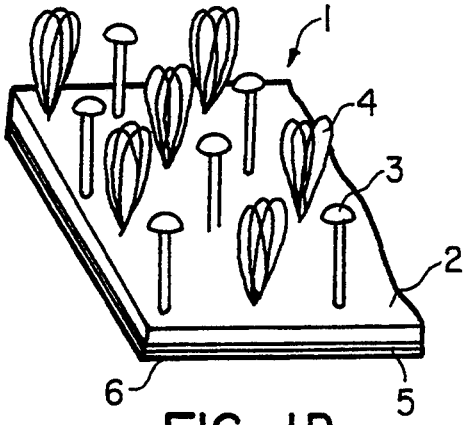
FIG. 1(*a*) and 1(*b*) show perspective views of examples of the mixed hook/loop separable fastener of the present invention.
Figure 1A:
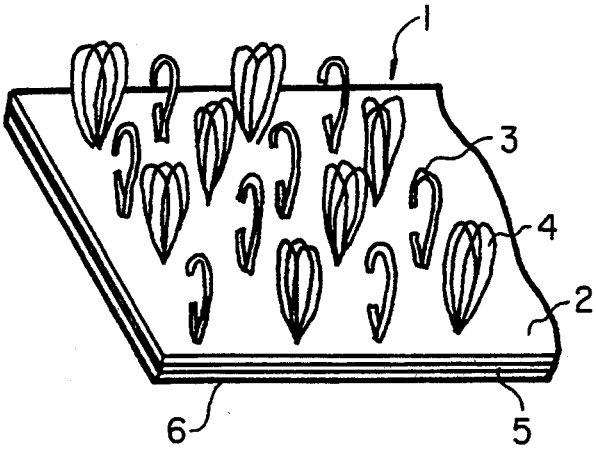

FIGS. 1(*a*) and 1(*b*) are perspective views each showing a mixed hook/loop separable fastener according to the present invention, wherein 1(*a*) is an example of a separable fastener comprising a synthetic monofilament as hook-like fastening elements and 1(*b*) one comprising plastic projections with a swollen head as hook-like fastening elements. These separable fastener comprise a base fabric 2 comprising a woven or knit fabric, a plastic sheet or the like and provided on one surface thereof with a multiplicity of hook-like fastening elements 3 and loop-like fastening elements 4. The base fabric comprising a woven or knit fabric generally has a thickness of 0.3 to 3.0 mm. The hook-like fastening elements 3 and loop-like fastening elements 4 are provided on the base fabric 2, as shown in FIG. 1, in lines. While the fastening elements 3 and 4 may be provided alternately each in a line or in 2 or more lines, it is preferred that the hook-like fastening elements 3 be, generally, provided in 2-line groups, in view of easy operation of cutting loops into hook-like fastening elements 3 or easy operation of fixing mushroom-shaped plastic projections. The lines of hook-like fastening elements 3 and those of loop-like fastening elements 4 may be arranged in parallel alternate lines oblique relative to the longitudinal direction of the base fabric, as shown in FIG. 1, or in any optional arrangement. Thus, the arrangement may for example be alternately parallel in the longitudinal direction of the base fabric, alternately zigzag, zigzag with one or both of the element-lines in 2 or 3 lines, in alternate concentric rings, or the like. In general, parallel alternate arrangement in the longitudinal direction of the base fabric is preferred because of ready preparation operation.

The above alternate arrangement of at least one line each of hook-like fastening elements and loop-like fastening elements allows the number of the hook-like fastening elements 3 provided on the base fabric to be equal to that of the loop-like fastening elements 4, which will make maximum the engaging strength when 2 sets of the separable fastener of the present invention are integrally attached to each other. In some cases, however, lines of either hook-like or loop-like fastening elements may be provided on both edges of the base fabric for the purpose of enhancing the commercial value of the separable fastener. In consideration of this kind of arrangement, the ratio to the total of the number of hook-like fastening elements or loop-like fastening elements ranges from 40 to 60%. Within this range, the engaging strength exhibited when 2 sets of the separable fasteners are integrally adhered face-to-face will not decrease. If however the ratio falls outside the above range, the balance between the two separable fasteners will be lost, whereby the engaging strength decreases significantly and below practical level.

The height of loop-like fastening elements 4 provided on one surface of a base fabric 2 is 1.5 to 4 mm and preferably 2 to 3 mm. If the height is smaller than 1.5 mm, the loop-like fastening element will hardly be engaged with the counterpart hook-like fastening elements 3 so that an engaging strength assuring practical use cannot be obtained. Furthermore, production of loop-like fastening elements having a smaller height than that is practically impossible. On the other hand, if the loop-like fastening elements are taller than 4 mm, it will become difficult to integrally and closely attach 2 sets of such separable fasteners to each other and the engagement, if once obtained, will tend to slip off.

The height of hook-like fastening elements 3 provided on one surface of the base fabric 2 is 1.3 to 3.8 mm and preferably 2 to 3 mm. Hooks having a height of less than 1.3 mm cannot be prepared by cutting loops woven into a base fabric and having a corresponding small height. Plastic projections with a swollen head and having a height smaller than 1.3 mm can hardly engage with the counterpart loops.

Figure 2A:
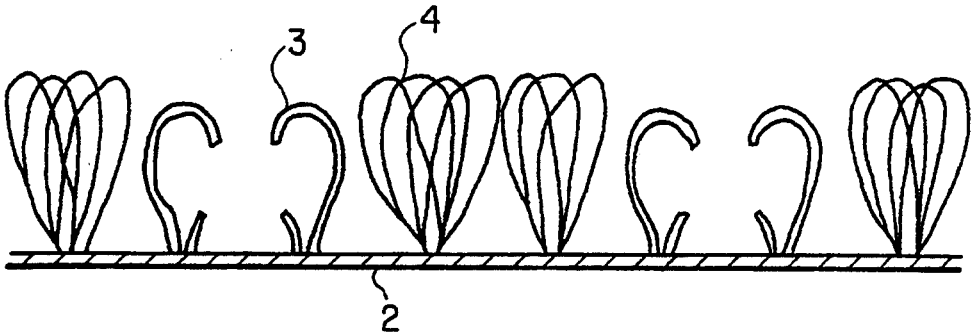
FIG. 2(*a*) and 2(*b*) show cross-sectional views of examples of the mixed hook/loop separable fastener of the present invention.
Figure 2B:
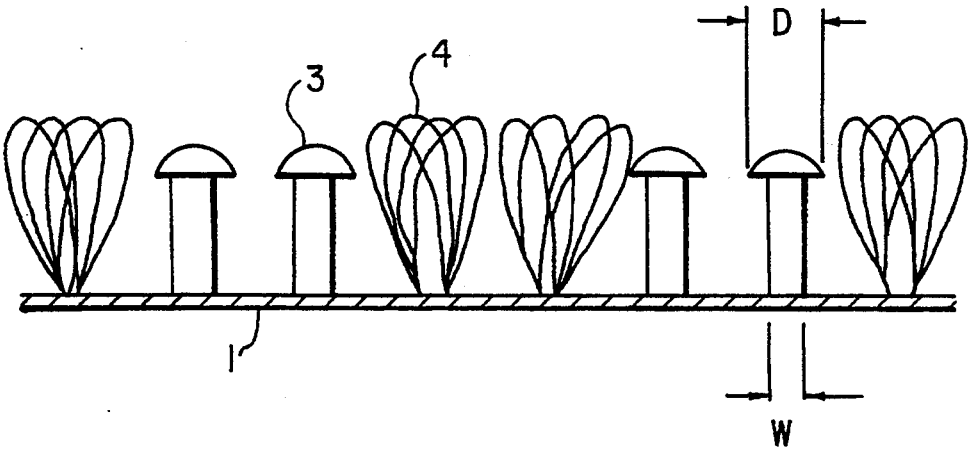

The height of loop-like fastening elements 4 is set 0.2 to 2.0 mm larger than that of hook-like fastening elements 3, as shown in FIG. 2(*a*) and 2(*b*). The height difference is in a range of 0.2 to 2.0 mm and preferably in a range of 0.3 to 1.0 mm. With a height difference of less than 0.2 mm, the following problems occur. Firstly, the surface of the separable fastener will, affected by hook-like fastening elements, feel coarse and give inferior touch when mounted on a wear or the like. Secondly, the hook-like fastening elements will tend to engage with other textile items or pick up waste threads or the like. Thirdly, when loops are cut to form hooks in the production process, the adjacent loop-like fastening elements may possibly be damaged. Lastly, it will be difficult to increase the density of loop-like fastening elements and hook-like fastening elements provided on the surface of a base fabric. On the other hand, if the height difference exceeds 2.0 mm, the engagement with the counterpart separable fastener will become difficult due to repellent force exerted by loop-like fastening elements, or, if ever engaged, the two separable fastener can hardly be integrally and closely adhered to each other.

The setting of the height of hook-like fastening elements at 1.3 to 3.8 mm and smaller than loop-like fastening elements can realize highly dense provision of hook-like fastening elements 3 and loop-like fastening elements 4 on one surface of a base fabric. According to the present invention, the hook-like fastening elements and loop-like fastening elements are provided in an overall density of 40 to 120 pieces/cm$^2$. While the density also depends on the diameter of the synthetic monofilament forming hook-like fastening elements or the shape of plastic projections and on the diameter and number of filaments constituting the multifilament yarn that forms loop-like fastening elements, it is generally preferred that the overall density be 60 to 90 pieces/cm$^2$. With a sum of the numbers of both fastening elements per square centimeter of less than 40, 2 sets of such separable fasteners will, when integrally adhered to each other, show an inferior engaging strength and be hardly put in practical use. If the sum exceeds 120, it will be difficult to cut loops of synthetic monofilament into hooks, or to fix on a base fabric so large a number of plastic projections having a swollen head.

Where a synthetic monofilament is used for preparing hook-like fastening elements, the monofilament generally has a diameter of 0.1 to 0.4 mm, preferably 0.14 to 0.25 mm. Hooks prepared from monofilaments having a diameter of less than 0.1 mm show too low an engaging strength and are hence not suited for hook-like fastening elements. On the other hand, monofilaments having a diameter of more than 4.0 mm are too thick to be cut with a cutting device and, if ever cut, feel coarse. Where plastic projections having a swollen head are used as hook-like fastening elements, the ratio (D/W) between the maximum length, D, of the cross-section of the swollen head and that, W, of the cross-section of the supporting part is preferably 1.5 to 3.5.

For preparing loop-like fastening elements, generally used are multifilament yarns consisting of single filaments having a diameter of 20 to 100$\mu$, preferably 35 to 95$\mu$. Such multifilament yarns combine 2 to 50 single filaments, preferably 3 to 30 single filaments.

The above monofilaments and multifilament yarns used for forming hook-like fastening elements and loop-like fastening elements, respectively, comprise synthetic fibers or metal fibers. In general fibers of thermoplastic resin such as polyamide, polyester, polypropylene and polyethylene are used. In particular, polyester is preferred since it exhibits high engaging strength and has high dimensional stability. Thermoplastic resins such as polyamide and polypropylene are also used for preparing plastic projections with a swollen head which constitute hook-like fastening elements.

Where a synthetic monofilament is used for hook-like fastening elements, the synthetic resin constituting it may generally constitute also a multifilament yarn used for preparing loop-like fastening elements. Synthetic fibers comprising different resins may however be used separately for hook-like fastening elements and loop-like fastening elements. In this case, the resin used for hook-like fastening elements preferably has a higher Young's modulus than that used for loop-like fastening elements. For example, synthetic fiber comprising polyester can be used for hook-like fastening elements when synthetic fiber comprising polyamide is used for loop-like fastening elements.

Figure 3B:
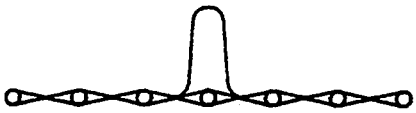
FIG. 3(*a*) and 3(*b*) show cross-sectional views illustrating how loops are woven onto a base fabric.
Figure 3A:
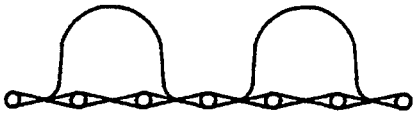

The above synthetic fibers for forming hook-like fastening elements and loop-like fastening elements are woven into a base fabric in the form of loops. The loops for forming hook-like fastening elements are generally woven into the base fabric such that each foot of individual loops is fixed onto the base fabric with an interval of a plurality, usually 2 pieces as shown in FIG. 3(*a*), of warps constituting the base fabric. Loops for forming loop-like fastening elements are generally woven into the base fabric such that each foot of the individual loops is, as shown in FIG. 3(*b*) and in the same manner as the usual female fastener component, fixed onto the base fabric with an interval of 1 warp.

Where plastic projections with a swollen head are used as hook-like fastening elements, the plastic projections are "planted" onto a base fabric. A synthetic monofilament can be formed into the plastic projections by interweaving the monofilament in the form of lines into 2 sheets of base fabric by joint-double weaving, cutting the monofilament between the 2 sheets and fusing by heating the cut tops to form swollen heads. The plastic projections can also be formed by weaving at the same time loops for forming hook-like fastening elements and those for forming loop-like fastening elements, cutting the top of the former and fusing by heating the cut tops to form swollen heads.

An adhesive layer 5 may be formed by applying an adhesive entirely or partly to the other surface of the base fabric 2 constituting the above mixed hook/loop separable fastener 1. The surface of the adhesive layer 5 is covered with a protective sheet 6 that is peelable from the adhesive layer. When the mixed hook/loop separable fastener is used, the protective sheet 6 is peeled off from the adhesive layer 5 and then the separable fastener can readily be mounted with increased working efficiency. Those separable fasteners having no adhesive layer on the other surface thereof can be fixed onto a wear or like items by sewing or like methods.

Figure 4:
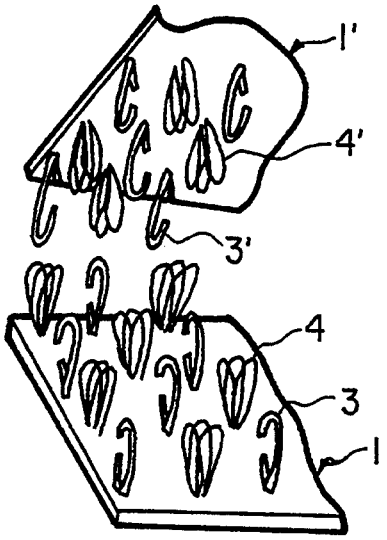
FIG. 4 shows a perspective view of a state where a pair of mixed hook/loop separable fasteners having the same construction are going to be engaged with each other.
Figure 5:
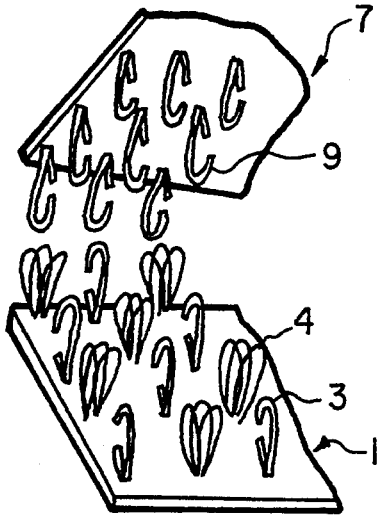
FIG. 5 shows a perspective view of a state where a mixed hook/loop separable fastener and a hook-like fastener component are going to be engaged with each other.
Figure 6:
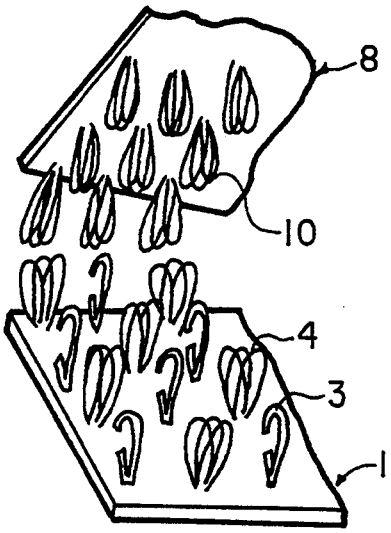
FIG. 6 shows a perspective view of a state where a mixed hook/loop separable fastener and a loop-like fastener component are going to be engaged with each other.

FIGS. 4 through 6 are perspective views showing examples how the mixed hook/loop separable fastener of the present invention is used. In FIG. 4, 2 sheets 1 and 1' of the mixed hook/loop separable fastener of the present invention and having the same construction are going to be integrally attached to each other. Here, the hook-like fastening elements 3 and loop-like fastening elements 4 provided on one separable fastener 1 are engaged with the loop-like fastening elements 4' and hook-like fastening elements 3', respectively.

The mixed hook/loop separable fastener of the present invention exhibits, when 2 sheets of the same construction are attached to each other, a tensile strength and a peeling strength of at least 0.50 kg/cm$^2$ and at least 55 g/cm, respectively. Separable fasteners having either a low tensile strength of less than 0.50 kg/cm$^2$ or a low peeling strength of less than 55 g/cm cannot be used in practice. In general, those having a tensile strength and a peeling strength of at least 0.60 kg/cm$^2$ and at least 60 g/cm are more preferably used. The tensile strength and peeling strength herein are determined in accordance with JIS L3416.

FIG. 5 is an example where the mixed hook/loop separable fastener 1 of the present invention are going to be engaged with a conventional male fastener component 7. The hook-like fastening elements 9 provided on the male fastener component 7 are going to engage with the loop-like fastening elements 4 provided on the mixed hook/loop separable fastener 1. FIG. 6 is an example where the mixed hook/loop separable fastener 1 of the present invention are going to engage with a conventional female fastener component 8. The loop-like fastening elements 10 provided on the female fastener component 8 are going to be engaged with the hook-like fastening elements 3 provided on the mixed hook/loop separable fastener 1. While the mixed hook/loop separable fastener of the present invention can be, as shown in FIGS. 5 and 6, engaged with a conventional male or female fastener component, the then obtained engaging strength should unavoidably become lower than that with 2 sheets of the same mixed hook/loop separable fastener being attached to each other. Further in FIGS. 5 and 6, the 2 sheets cannot be so closely attached to each other as in the case of 2 sheets of the mixed-type fastener.

To summarize, the mixed hook/loop separable fastener of the present invention, comprising on one surface of a base fabric a multiplicity of hook-like fastening elements and a multiplicity of loop-like fastening elements intermixed with each other, with the height of the latter being larger than that of the former, has the following advantages:

a) Can use 2 sheets of the same construction;
b) Assures high density of both hook-like fastening elements and loop-like fastening elements;
c) Exhibits an engaging strength similar to that obtained with the usual combination of male fastener component and a female fastener component; and
d) Has a good surface touch and causes no damage to adjacent textiles for example during washing or picks up no waste threads and the like.

Now described by reference to FIGS. 7 through 12 are the processes for producing the mixed hook/loop separable fastener of the present invention that utilizes a synthetic monofilament for its hook-like fastening elements.

The production process of the present invention proceeds as follows.

Figure 7:
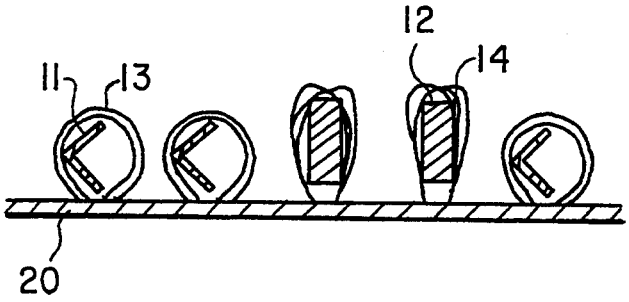
FIG. 7 is a cross-sectional view showing a base fabric with two types of loops woven thereinto, one for forming hook-like fastening elements and the other for loop-like fastening elements.

There are provided on a base fabric 20, as shown in FIG. 7, a plurality of parallel lines of monofilament round loops 13 and a plurality of parallel lines of double yarn round loops 14. The lines are arranged such that 2 monofilament loop lines and 2 multifilament yarn loop lines appear alternately; in other words, 2-line groups of monofilament loops are arranged with an interval space where each of another 2-line groups of multifilament yarn loops is arranged. The lines of monofilament round loops 13 are formed by weaving a synthetic monofilament around each one of inserts 11 having a folded cross-sectional configuration and arranged parallel, in 2 piece-sets with an interval in the longitudinal direction of the base fabric 20. The lines of multifilament yarn round loops 14 are formed by weaving a synthetic multifilament yarn around each of inserts 12 having a rectangular cross-sectional configuration and arranged parallel, in 2 piece-set, each in the above interval space formed by the inserts 11. With respect to the height of these loops, the multifilament yarn loops are generally woven such that their height is 0.2 to 2.0 mm larger than that of the monofilament loops. Where the monofilament loops comprise a synthetic monofilament having a larger heat shrinkage than that of the multifilament yarn used, both types of loops may have the same height. In this case, it is necessary, after the monofilament loop lines and multifilament yarn loop lines have been provided, to carry out heat treatment so that the multifilament yarn loops will become higher by 0.2 to 2.0 mm than the monofilament loops. The heat treatment for this purpose is generally carried out, after the monofilament loops and multifilament yarn loops have been woven into a base fabric, by blowing superheated steam at a temperature of 190° to 240° C.

Figure 11:
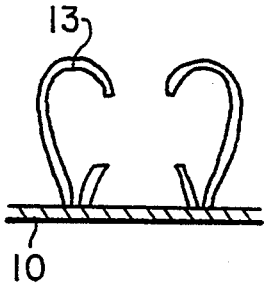
FIG. 11 is a cross-sectional view of an example of hook-like fastening element.
Figure 8:
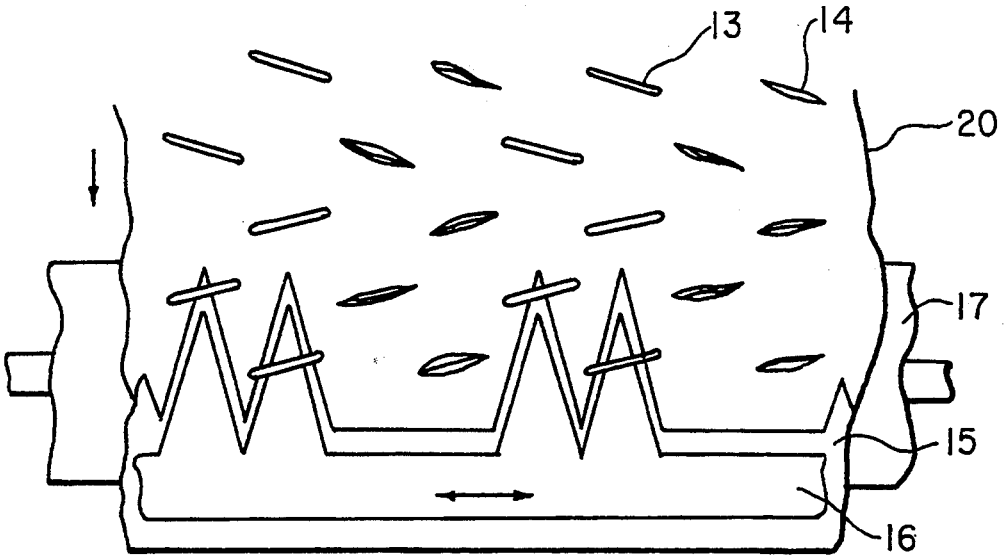
FIG. 8 is a plan view of an apparatus for producing the mixed hook/loop separable fastener of the present invention.
Figure 9:
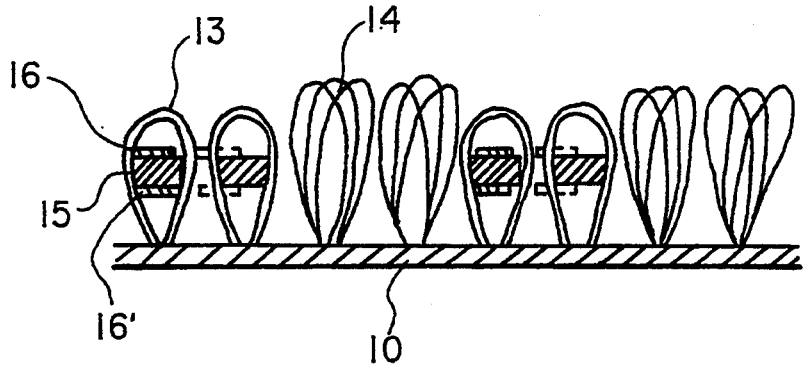
FIG. 9 is a cross-sectional view of an apparatus for producing the mixed hook/loop separable fastener of the present invention.
Figure 10:
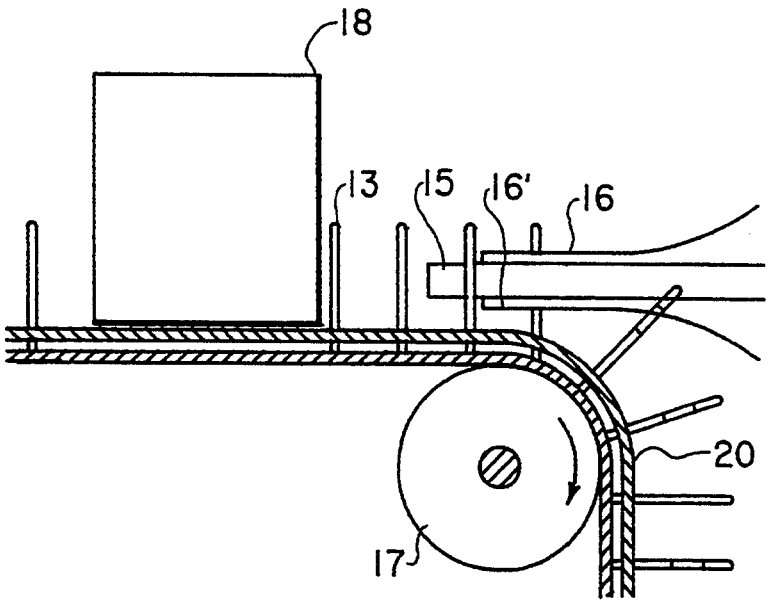
FIG. 10 is a side view of an apparatus for producing the mixed hook/loop separable fastener of the present invention.
Figure 12:
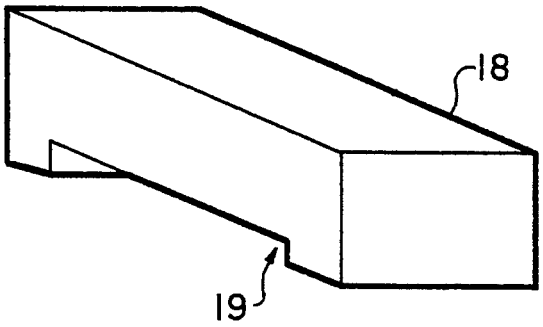
FIG. 12 is a perspective view of a guide used for producing the mixed hook/loop separable fastener of the present invention.

The base fabric 20 provided with the monofilament loops 13 and the multifilament yarn loops 14 is then supplied to a cutting apparatus. The cutting apparatus comprises, as shown in FIGS. 8 through 10, a fixed cutting blade 15 having a comb shape with a constant thickness and being so constructed as to permit its teeth to thrust only into monofilament loop lines, and two sets of movable comb-shaped cutting blades provided on top and bottom of the fixed blade and so constructed as to permit their teeth to thrust only into monofilament loop lines. The 2 sets of the movable cutting blades are horizontally slideably pressed onto the fixed blade. The cutting apparatus is positioned above a roll 17 for moving the base fabric 20 provided with the monofilament loops 13 and the multifilament yarn loops 14. When the base fabric is transferred by the roll in the direction of arrow, the fixed cutting blade 15 and the movable cutting blades 16 and 16' thrust into the monofilament loops 13 and at the same time the movable cutting blades move horizontally and reciprocally. The reciprocal horizontal movement of the movable cutting blades cut part of the side of each of adjacent monofilament loops, the part corresponding to the thickness of the fixed cutting blade 15, whereby hook-like fastening elements 13 having a wide opening as shown in FIG. 11.

If, when the monofilament loops are cut with the above cutting apparatus, the multifilament yarn loops and the monofilament loops have the same height, the following troubles will most often occur. When the movable cutting blades 16 and 16' moves horizontally and reciprocally, they may contact some of the multifilament yarn loops and cut some of the single filaments constituting the multifilament yarn. Where, in particular, the monofilament loops and the multifilament yarn loops are provided on the base fabric in a high density, the 2 types of loops will sometimes partly contact with each other or partly overlap when seen from a point toward which the fabric moves. Then, when the fixed cutting blade and the movable cutting blades thrust into the monofilament loops, they also thrust into part of the multifilament yarn loops or part of the single filaments constituting the multifilament yarn, thereby cutting the part of the multifilament yarn loops or the single filaments constituting the multifilament yarn.

It is necessary that the base fabric to be supplied to the cutting apparatus be precisely positioned relative to the position of the cutting blades so that the monofilament loop lines match the blade teeth. For this purpose, a guide 18 is installed before the cutting apparatus and in the transversal direction relative to the machine direction. As shown perspectively in FIG. 12, the guide 18 has a rectangular concave having the same width as that of the base fabric and a depth that can just allow the fabric to pass through, thus assuring the precise cutting of the monofilament loops.

Figure 13:
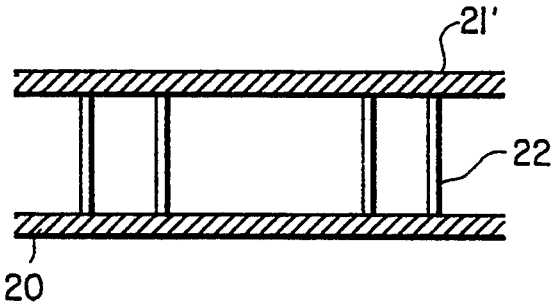
FIGS. 13 and 14 are diagrammatical drawings illustrating the process for producing the mixed hook/loop fastener of the present invention.
Figure 14:
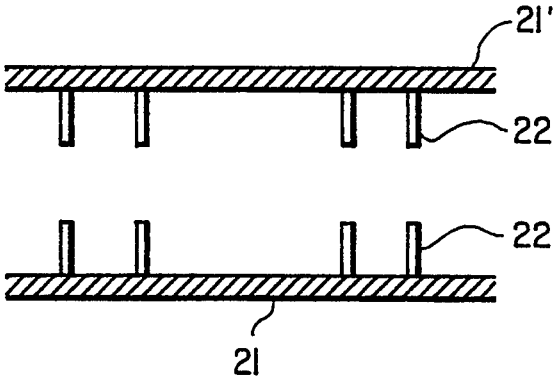

Next described is the process for producing a mixed hook/loop separable fastener utilizing plastic projections having a swollen head as hook-like fastening elements, by reference to FIGS. 13 and 14.

At first, 2 sheets of base fabric 21 and 21' are placed one over another with a properly selected space. Lines of a monofilament 22 are woven into the fabrics by joint double weaving. The monofilament of each of the lines woven into the fabrics is cut between the fabrics to obtain 2 sheets of fabrics 21 and 21'. The cut tops of the monofilament 22 are fused by applying a heating means such as heating plate at 500° to 600° C. to form hook-like fastening elements each comprising a vertical projection having mushroom-shaped swollen head part and a height of 1.3 to 3.8 mm. The shape of the swollen head can be modified by properly selecting the heating temperature and heating time.

Thereafter, there are formed between lines of the above hook-like fastening elements, lines of loop-like fastening elements comprising round loops formed by a multifilament yarn of a synthetic fiber and being 0.2 to 2.0 mm higher than the hook-like fastening elements to obtain the intended mixed hook/loop separable fastener comprising hook-like fastening elements of plastic projections with a swollen head.

To summarize, the process of the present invention for producing a mixed hook/loop separable fastener, comprises alternately providing at least one line of round loops for forming hook-like fastening elements and formed of a synthetic monofilament on one surface of a base fabric, and adjacent the line of monofilament round loops at least one line of round loops for constituting loop-like fastening elements and formed of a synthetic multifilament yarn, with the height of the multifilament yarn loops being set higher than that of monofilament loops, whereby:

i) with the separable fasteners utilizing a synthetic monofilament for hook-like fastening elements, when loops are cut with cutting blades to form hook-like fastening elements, the adjacent loop-like fastening elements are not damaged so that high production efficiency is assured; and ii) with the separable fasteners utilizing plastic projections having a swollen head part, loop-like fastening elements can readily be woven into the base fabric.

The thus obtained mixed hook/loop separable fasteners of the present invention can be used for various objects, including the uses of conventional separable fasteners, such as clothing use. Example of such uses are housing and construction uses, such as laying tiles, fixing doors, fixing ceiling boards, fixing wall materials and laying artificial turf; interior uses, such as laying carpets, laying floor panels, fixing desks, preventing furniture from toppling, hanging up pictures or the like, mounting curtains and fixing shelves; office interior uses, such as connecting or fixing partitions, laying floor carpets and preventing OA appliances from toppling; car interior uses, such as laying seat covers, fixing door trims and fixing instrument panels.

In the above uses, the mixed hook/loop separable fasteners can be attached to the objects to be fastened by any one of known attaching methods, such as application of an adhesive, high-frequency welding, supersonic welding, fusion and sewing.

EXPERIMENTAL EXAMPLES

Other features of the invention will become apparent in the course of the following descriptions of exemplary embodiments which are given for illustration of the invention and are not intended to be limiting thereof.

Experimental Examples 1 through 4

There were prepared 4 sheets of a base fabric having a width of 2.5 cm and formed of a polyamide multifilament yarn having a fineness of 110 deniers/10 filaments for both warps and wefts. The fabrics were each provided on one surface thereof, in an arrangement as shown in FIG. 8, with lines of loops for forming hook-like fastening elements, formed by weaving a polyamide monofilament having a fineness of 330 deniers (diameter: 0.2 mm) and having a height of 1.3 mm, 1.6 mm, 3.3 mm or 3.6 mm. The fabrics were then each provided with lines of loops for constituting loop-like fastening elements, having a height of 3.8 mm and formed by weaving a polyamide multifilament yarn having a fineness of 210 d/10 fil. The density of total loops woven into the fabrics was 60 pieces/cm$^2$ and the ratio between the number of loops for loop-like fastening elements and those for hook-like fastening elements was 1:1. The fabrics were then heat treated with a superheated steam at 195° C. for 15 seconds. After the heat treatment, the loops for loop-like fastening elements had a height of 3.2 mm and the loops for forming hook-like fastening elements had heights of 1.0 mm, 1.3 mm, 3.0 mm and 3.3 mm. Polyurethane resin was applied to the back surface of the fabrics to fix the loops, and the fabrics were supplied to a cutting apparatus, which cut the upper part of the loops for hook-like fastening elements, to give 4 types of mixed hook/loop separable fasteners. The fasteners were tested for engaging strength by attaching 2 sheets having the same construction to each other. The results are shown in Table 1.

TABLE 1

| Experimental Example | Height of hook-like fastening elements (mm) | Height difference between fastening elements (mm) | Tensile strength (kg/cm$^2$) | Peeling strength (g/cm) |
|---|---|---|---|---|
| 1 | 1.0 | 2.2 | 0.3 | 40 |
| 2 | 1.3 | 1.9 | 0.6 | 60 |
| 3 | 3.0 | 0.2 | 0.6 | 70 |
| 4 | 3.3 | −0.1 | 0.3 | 50 |

Experimental Examples 5 through 8

There were prepared 4 sheets of a base fabric having a width of 2.5 cm and formed of a polyester multifilament yarn having a fineness of 100 d/20 fil. for both warps and wefts. The fabrics were each provided on one surface thereof with lines of loops for forming hook-like fastening elements and having a height of 2.5 mm and those of loops for loop-like fastening elements and having a height of 2.8 mm. The former was formed by weaving a polyester monofilament having a fineness of 280 deniers (diameter: 0.17 mm), while the latter by weaving a polyester multifilament yarn having a fineness of 250 d/15 fil. The density of total loops woven into each of the fabrics was 30, 50, 110 or 125 pieces/cm$^2$ and the ratio between the number of the loops for loop-like fastening elements and that of the loops for hook-like fastening elements was 1:1. The loops were fixed by applying a polyurethane resin to the back of the base fabrics, and the fabrics were heat treated with a superheated steam at 200° C. for 10 seconds. After the heat treatment, the loops for forming hook-like fastening elements and those for loop-like fastening elements had a height of 1.9 mm and 2.2 mm, respectively. The fabrics were then supplied to a cutting apparatus, which cut the upper part of the loops for hook-like fastening elements, to give 4 types of mixed hook/loop separable fasteners. The fasteners were tested for engaging strength by attaching 2 sheets having the same construction to each other. The results are shown in Table 2.

TABLE 2

| Experimental Example | Density of loops & hooks (pieces/cm$^2$) | Tensile strength (kg/cm$^2$) | Peeling strength (g/cm) |
|---|---|---|---|
| 5 | 30 | 0.36 | 42 |
| 6 | 50 | 0.65 | 65 |
| 7 | 110 | 1.17 | 130 |
| 8 | 125 | 0.53 | 88 |

Experimental Examples 9

Into the same base fabric as used in Experimental Example 1, loops for forming hook-like fastening elements having a height of 2.2 mm and those for loop-like fastening elements having a height of 2.2 mm were woven in an arrangement as shown in FIG. 8. The loops for forming hook-like fastening elements comprised a polypropylene monofilament having a fineness of 300 d (diameter: 0.21 mm), while those for loop-like fastening elements a polypropylene multifilament yarn having a fineness of 180 d/48 fil. The density of the monofilament loops was 30 pieces/cm$^2$ and that of multifilament yarn loops was 40 pieces/cm$^2$, overall density thus being 70 pieces/cm$^2$. The fabric was then heat treated in a vapor at 110° C. for 20 seconds and allowed to cool. After the cooling, the loops for hook-like fastening elements and those for loop-like fastening elements had heights of 1.5 mm and 1.8 mm, respectively. A polyurethane resin was applied on the back of the fabric to fix the loops, and thereafter the loops for hook-like fastening elements were cut to obtain a mixed hook/loop separable fastener. Two sheets of the thus obtained separable fastener were attached to each other and tested for engaging strength. The fastener showed a tensile strength of 0.67 kg/cm$^2$ and a peeling strength of 71 g/cm.

Experimental Example 10

Two sheets of a base fabric composed of warps and wefts both of a polyamide multifilament yarn having a fineness of 900 d/10 fil. were placed one over another with a space of 8 mm maintained therebetween. A polypropylene monofilament having a fineness of 1,000 d (diameter: 0.34 mm) was interwoven into the fabrics in 2-line groups with an interval between adjacent groups and in a density to make the resulting density of projections 50 pieces/cm$^2$. The monofilament bridges were cut just between the fabrics so that a multiplicity of projections having a height of 4 mm were obtained. A steel plate heated to a temperature of 600° C. was applied to the ends of the projections to fuse each into a mushroom-shaped swollen head. The fabric was thus provided on one surface thereof with a multiplicity of hook-like fastening elements having a height of 2.0 mm. The ratio of the diameters of the supporting part and swollen head (swollen head/support) was 3.0 and the length of the supporting part was 1.5 mm. Next, around 2 piece each of inserts placed in the empty spaces formed by 2-line groups of the hook-like fastening elements, 2 lines each of loops for loop-like fastening elements and having a height of 2.5 mm were woven using a polyamide multifilament yarn having a fineness of 250 d/15 fil. The density of the loops for loop-like fastening elements was 50 pieces/cm$^2$. The ratio between the number of loop-like fastening elements and that of hook-like fastening elements was 1:1. A polyurethane resin was applied on the back of the fabric to fix the loops. The thus obtained separable fastener was tested for engaging strength by attaching 2 same specimen sheets to each other. It showed a tensile strength of 2.0 kg/cm$^2$ and a peeling strength of 320 g/cm.

Experimental Example 11

Into the same base fabric as used in Experimental Example 10, loops for hook-like fastening elements and having a height of 2.5 mm and those for loop-like fastening elements and having a height of 2.5 mm were woven. The loops for hook-like fastening elements comprised a polypropylene monofilament having a fineness of 1,000 d (diameter: 0.34 mm), while those for loop-like fastening elements comprised a polyester multifilament yarn having a fineness of 250 d/15 fil. The overall density of the loops was 100 pieces/cm$^2$. After the loops had been fixed by applying a polyurethane resin on the back of the fabric, the top part of each of the loops for hook-like fastening elements was cut, and the cut tops were fused by heating with a far infrared radiation heater at 200° C. each into a mushroom-shaped swollen head having a height of 1.8 mm. The thus obtained separable fastener was tested for engaging strength by attaching 2 same specimen sheets to each other. It showed a tensile strength and a peeling strength of 2.1 kg/cm$^2$ and 330 g/cm, respectively.

Experimental Examples 12 through 15

The surface smoothness of the mixed hook/loop separable fasteners of the present invention was evaluated as follows. The mixed hook/loop separable fasteners obtained in Experimental Examples 2 through 4 and having a width and length of 2.5 cm and 15 cm respectively, and a commercial male fastener component (A0380, made by Kuraray Co., Ltd.) (Experimental Example 15) and a commercial female fastener component (B1,000, made by Kuraray Co., Ltd.) (Experimental Example 16) both having the same dimensions as above were fixed by adhesion on a plane, with the surface provided with fastening elements facing up. A moving mass was prepared by fixing by adhesion a pile fabric (E-4,500, made by Mochida Shoko Co., Ltd.) on a steel plate having a width and length of 5 mm and 15 cm, respectively, and weighing 70 g. The moving mass thus prepared was placed with the piles facing down on each of the fastener sample, and pulled horizonally in the longitudinal direction with a spring balance. The indication of the balance when the mass started moving was recorded. The results are shown in Table 3.

TABLE 3

| Experimental Example | Pulling force (g) | Separable fastener attached to the moving mass |
|---|---|---|
| 12 | 60 | Obtained in Exp. Ex. 2 |
| 13 | 150 | Obtained in Exp. Ex. 3 |
| 14 | 650 | Obtained in Exp. Ex. 4 |
| 15 | 3600 | Commercial male fastener |
| 16 | 40 | Commercial female fastener |

As is apparent from the above table, the mixed hook/-loop separable fasteners of the present invention have a surface condition (smoothness) similar or close to that of commercial female fastener.

Experimental Examples 17 and 18

The mixed hook/loop separable fastener obtained in Experimental Example 7 and having a width of 2.5 cm was engaged with the same fastener, a commercially available male fastener component (A8695, density of hooks: 40 pieces/cm$^2$, made by Kuraray Co., Ltd.), or a commercially available female fastener (B2006, density of loops: 60 pieces/cm$^2$, made by Kuraray Co., Ltd.), and tested for each engaging strength. The results are shown in Table 4.

The tensile strength and peeling strength exerted when the above male and female fasteners are engaged with each other were 1.12 kg/cm$^2$ and 112 g/cm, respectively.

TABLE 4

| Experimental Example | Separable fastener engaged with Exp. Ex. 7 | Tensile strength (kg/cm$^2$) | Peeling strength (g/cm) |
|---|---|---|---|
| 17 | Male fastener (A8695) | 0.8 | 80 |
| 18 | Female fastener (B2006) | 0.7 | 70 |
| 7 | Exp. Ex. 7 itself | 1.17 | 130 |

Obviously, numerous modification and variations of the present invention are possible in light of the above teachings. It is therefore to be understood that within the scope of the appended claims, the invention may be practiced otherwise than as specifically described herein.

What is claimed is:

1. A mixed hook/loop separable fastener comprising a base fabric provided on one surface thereof intermixedly with a multiplicity of hook-like fastening elements and a multiplicity of loop-like fastening elements, wherein:

said hook-like fastening elements have a height of 1.3 to 3.8 mm and said loop-like fastening elements have a height of 1.5 to 4 mm and larger by 0.2 to 2.0 mm than a height of said hook-like fastening elements, such that top portions of said loop-like elements extend above top portions of said hook-like elements so as to act as cover over said hook-like elements to prevent damage to adjacent textiles by said hook-like elements and provide for a smooth contact surface; and said hook-like fastening elements and loop-like fastening elements are provided in a density of 50 to 120 pieces/$cm^2$.

2. A mixed hook/loop separable fastener according to claim 1, further having a tensile strength and peeling strength as determined according to JIS L-3416 on a sample obtained by attaching two sheets having the same construction to each other of at least 0.50 kg/$cm^2$ and at least 55 kg/cm, respectively.

3. A mixed hook/loop separable fastener according to claim 1, wherein said hook-like fastening elements comprise a synthetic monofilament having a diameter of 0.1 to 0.4 mm and said loop-like fastening elements comprise a synthetic multifilament yarn consisting of 2–50 filaments having a diameter of 20 to 100 $\mu$.

4. A mixed hook/loop separable fastener according to claim 3, wherein at least said hook-like fastening elements comprise polyester fiber or polyamide fiber.

5. A mixed hook/loop separable fastener according to claim 3, wherein said hook-like fastening elements comprise a synthetic fiber having a larger heat shrinkage than that of a synthetic fiber used for said loop-like fastening elements.

6. A mixed hook/loop separable fastener according to claim 5, wherein said hook-like fastening elements comprise polypropylene fiber and said loop-like fastening elements comprise polyester fiber or polyamide fiber.

7. A mixed hook/loop separable fastener according to claim 1, wherein said hook-like fastening elements comprise shaped projections having a swollen head at each of their ends and said loop-like fastening elements comprise a multifilament yarn consisting of 2–50 filaments having a diameter of 20 to 100 $\mu$.

8. A mixed hook/loop separable fastener according to claim 7, wherein said hook-like fastening elements are mushroom-shaped.

9. A mixed hook/loop separable fastener according to claim 8, wherein said mushroom-shaped projections are formed from a thermoplastic synthetic monofilament having a diameter of 0.1 to 0.5 mm.

10. The use of mixed hook/loop separable fasteners comprising attaching to each other two sheets of a mixed hook/loop separable fastener having the same construction, wherein:

said separable fastener comprises a base fabric provided on one surface thereof intermixedly with a multiplicity of hook-like fastening elements and a multiplicity of loop-like fastening elements;

said hook-like fastening elements have a height of 1.3 to 3.8 mm and said loop-like fastening elements have a height of 1.5 to 4 mm and larger by 0.2 to 2.0 mm than a height of said hook-like fastening elements, such that top portions of said loop-like elements extend above top portions of said hook-like elements so as to act as cover over said hook-like elements to prevent damage to adjacent textiles by said hook-like elements and provide for a smooth contact surface; and said hook-like fastening elements and loop-like fastening elements are provided in a density of 50 to 120 pieces/$cm^2$.

* * * * *

UNITED STATES PATENT AND TRADEMARK OFFICE

CERTIFICATE OF CORRECTION

PATENT NO. : 5,369,852

DATED : December 6, 1994

INVENTOR(S) : Yukitoshi HIGASHINAKA

It is certified that error appears in the above-indentified patent and that said Letters Patent is hereby corrected as shown below:

On the title page, Item [*], the Terminal Disclaimer Date is listed incorrectly. It should read:

--Aug. 3, 2010--

Signed and Sealed this

Thirtieth Day of May, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,369,852

DATED : December 6, 1994

INVENTOR(S) : YUKITOSHI HIGASHINAKA

It is certified that error appears in the above-indentified patent and that said Letters Patent is hereby corrected as shown below:

In column 5, line 27, change "fastener" to --fasteners--.

In column 12, line 59, change "Examples" to --Example--.

In column 14, line 22, change "5 mm" to --5 cm--.

In column 15, line 29, change "55 kg/cm" to --55 g/cm--.

Signed and Sealed this

Twentieth Day of August, 1996

Bruce Lehman

*Attest:*

BRUCE LEHMAN

*Attesting Officer*

*Commissioner of Patents and Trademarks*